US006463246B1

(12) United States Patent
Mizuno et al.

(10) Patent No.: US 6,463,246 B1
(45) Date of Patent: Oct. 8, 2002

(54) DEVELOPER, DEVELOPMENT METHOD, DEVELOPMENT DEVICE AND ITS ELEMENTS, AND IMAGE-FORMING DEVICE

(75) Inventors: Tsuneo Mizuno; Toshihiro Yukawa; Tomoaki Tanaka; Atsushi Tano; Tetsu Takahashi, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/531,683

(22) Filed: Mar. 20, 2000

(30) Foreign Application Priority Data

Aug. 4, 1999 (JP) ..... 11-220829

(51) Int. Cl.[7] ..... G03G 15/08

(52) U.S. Cl. ..... 399/284; 399/279; 399/281; 399/285

(58) Field of Search ..... 399/274, 284, 399/252, 279, 280, 281, 282, 285, 286; 118/261

(56) References Cited

U.S. PATENT DOCUMENTS 4,852,541 A 8/1989 Kodama et al.
5,649,197 A 7/1997 Fujita
5,937,253 A * 8/1999 Shimazaki et al. ..... 399/284
6,253,052 B1 * 6/2001 Cornelius et al. ..... 399/274

FOREIGN PATENT DOCUMENTS

| | | |
|---|---|---|
| JP | 6-102748 | 4/1994 |
| JP | 8-202130 | 8/1996 |
| JP | 9-274376 | 10/1997 |
| JP | 10-142946 | 5/1998 |

* cited by examiner

*Primary Examiner*—Hoang Ngo
(74) *Attorney, Agent, or Firm*—Armstrong, Westerman & Hattori, LLP

(57) ABSTRACT

It is an exemplified object of the present invention to provide a developer, a development device and its elements, and an image-forming device that can more stably form a high-quality image by a relatively inexpensive and easy means. A noncontact-type development method according to the present invention utilizes a nonmagnetic and single component toner having a volume average particle diameter D ($\mu$m) and an average specific charge q/m ($\mu$C/g), a development roller having a ten-point average surface roughness Rz ($\mu$m), and a blade keeping in contact with the development roller at a blade line pressure Pb (gf/cm). In order to stably form a uniform toner layer dt ($\mu$m) on the development roller, the following relationship is to be met: $dt=1.8\times\{q/m\times Rz/(Pb-1)\}^{1/2}\times D\pm0.25\ D$, and $1.5\ D\leqq dt\leqq 3.5\ D$.

7 Claims, 4 Drawing Sheets

DEVELOPER, DEVELOPMENT METHOD, DEVELOPMENT DEVICE AND ITS ELEMENTS, AND IMAGE-FORMING DEVICE

BACKGROUND OF THE INVENTION

The present invention relates generally to developers, development methods, development devices and their elements, and image-forming devices, and more particularly to a nonmagnetic and single component developer, a development method using the nonmagnetic and single component developer, a development roller, a blade regulating a thickness of a nonmagnetic and single component developer layer on the development roller, a method for forming a nonmagnetic and single component developer layer using the blade, a development device having the development roller and the blade, and an electrophotographic image-forming device having one or more of these elements. The present invention is suitable for a color laser printer, for example.

Hereupon, the "nonmagnetic and single component developer" is a single component developer that is not magnetized and includes no carrier. The "electrophotographic image-forming device", which is typically a laser printer, is a non-impact printer that provides recording by depositing a developer as a recording material on a recorded medium (e.g., printing paper and OHP film).

With the recent development of office automation, the use of electrophotographic image-forming devices such as a laser printer for computer's output devices, facsimile machines, copiers, etc. have been spreading steadily. The electrophotographic process generally employs a photoconductive insulator (photosensitive drum), and includes the steps of charging, exposure to light, development, transfer, fixing, and other post processes.

The charging step uniformly electrifies the photosensitive drum (e.g., at −600 V). The exposure step irradiates a laser beam etc. onto the photosensitive drum and changes the electrical potential at the irradiated area down, for example, to −50 V or so, forming an electrostatic latent image. The development step electrically deposits the developer onto the photosensitive drum using, for example, a reversal process, and visualizes the electrostatic latent image. The reversal process is a development method that forms an electric field by a development bias in areas where electric charge is eliminated by exposure to light, and deposits the developer having the same polarity as uniformly charged areas on the photosensitive drum by the electric field. The transfer step forms a toner image corresponding to the electrostatic latent image on a recorded medium. The fixing step fuses and fixes the toner image on the recorded medium using the heat, pressure, etc., thereby obtaining a printed matter. The post processes may include a discharge and cleaning of the transferred photosensitive drum, a collection and recycle and/or disposal of residual toner, etc.

The developer for use with the aforementioned development step can be broadly divided into a single component system developer using the toner, and a binary component system developer using the toner and carrier. The toner may use a particle prepared, for example, in such a manner that a colorant such as a dye and a carbon black, or the like is dispersed in a binder resin made of synthetic macromolecular compound, and then is ground into a fine powder of approximately 3 through 15 $\mu$m. A usable carrier may include, for example, an iron powder or ferrite bead of approximately 100 $\mu$m in diameter. The single component system developer advantageously results in (1) simple and miniature development equipment due eliminating a carrier deterioration, toner density control, mixing, and agitation mechanisms, and (2) used toner without any waste such as a carrier.

The single component system developer may be further classified into a magnetic and single component developer that includes toner in a magnetic powder, and nonmagnetic and single component developer that does not include the same. However, the magnetic and single component developer is disadvantageous in (1) the low transfer performance due to the high content of low electrical resistant magnetic powder which hinders the increased electric charge amount, (2) the bad colorization due to its low transparent, black-color magnetic powder, (3) the low fixing performance due to the magnetic powder which requires high temperature and/or high pressure, increasing a running cost. Accordingly, the nonmagnetic and single component developer without these disadvantages is expected to be in increasing demand in future.

The nonmagnetic and single component developer commonly uses the toner having a relatively high volume resistivity (e.g., at 300 GΩ·cm, etc.). In addition, the toner, as basically carrying no electric charges, needs to be charged by the triboelectricity or charge injection in the development device.

The development method employing the nonmagnetic and single component developer is divided into contact and noncontact development methods: The contact-type development method deposits a developer on the photosensitive drum by bringing the development roller carrying the developer into contact with the photosensitive drum; and the noncontact type development method provides a certain gap (e.g., of about 350 $\mu$m) between the development roller and the photosensitive drum to space them from each other, and flies the developer from the development roller to and deposits the same onto the photosensitive drum. Disadvantageously, the contact-type development method may deteriorate the developer by friction between the development roller and the photosensitive drum, and besides cause crack the photosensitive film, shortening the life of photosensitive body. Accordingly, the noncontact-type development method without these deteriorations has recently been highlighted.

It is significant for the noncontact-type development process employing the nonmagnetic and single component developer to ensure a sufficient image density by controlling the amount of toner flying from the development roller to the photosensitive drum. Thus, it is important to form a toner thin layer while controlling its thickness on the development roller. As a typical method for regulating a toner layer thickness, it has conventionally been proposed to provide an elastic blade (restriction blade) in contact with the development roller to maintain the layer thickness uniform.

The development equipment applying the noncontact-type development method employing the nonmagnetic and single component developer generally comprises a reset roller, a development roller, and a blade. The development roller is connected with a bias power supply, and provided with the development bias of superposed AC and DC voltages from the bias power supply. The reset roller, which is also called a supply roller or application roller, contacts the development roller: The reset roller serves not only to supply the toner to the development roller, and but also to scrape off and remove the toner unused for the development and remaining on the development roller. The development roller, which is, for example, a roller made of metal such as aluminum, adsorbs the charged toner on its surface in the form of the thin layer, and conveys it to a development area.

The blade contacts the development roller and serves to regulate the toner layer to a uniform thickness. The blade may be made up of one elastic member such as urethane, or of a metal member having a contact portion made of resin with the development roller. For instance, according to Japanese Patent Publications (Kokai) Nos. 8-202130 and 6-102748, when a metal member, namely a rigid member, is used for the development roller, the toner layer may be regulated by bringing a blade made of an elastic body such as rubber into contact with the development roller; on the other hand, when a member made of an elastic body such as rubber is used for a surface of the development roller, the toner layer may be regulated by bringing an end portion or non-end portion (namely midsection) into contact with the development roller. In order to avoid damaging the development roller and the blade by mitigating the accuracy in contact pressure required at the contact portion between them, these prior art have devised to use a contact between one that is rigid and the other that is elastic. Japanese Patent Publications (Kokai) Nos. 8-202130 and 6-102748 also disclose a surface roughness of the development roller, a pressure with which the blade is pressed against the development roller (blade pressure), a toner particle diameter, and other conditions for forming a toner layer as shown in Table 1 below.

TABLE 1

| Each member/Prior Art Refs. | | JP KoKai 8-202130 | JP KoKai 6-102748 |
|---|---|---|---|
| Development roller | Materials | Aluminum or other elastic bodies | Aluminum |
| | Surface Roughness | Central line average roughness 1.5 $\mu$m | Ten-point average roughness Rz 1–10 $\mu$m |
| Blade | Materials | Urethane or other elastic bodies. Or metal member if the development roller is an elastic body | Urethane rubber |
| | Blade Pressure | 20–200 gf/cm | 5–200 gf/cm |
| Toner | Average Particle Diameter | 6 $\mu$m | 8 $\mu$m |

In operation, the toner is charged (e.g., negatively) by sliding friction among the reset roller, the blade, and the development roller. The negatively charged toner thereafter is fed onto a surface of the development roller by the reset roller, and deposited thereon by electrostatic adsorption. Subsequently, the toner layer on the development roller is leveled by the blade to form a thin layer having a uniform thickness of about 10 $\mu$m through 40 $\mu$m. The toner, which has been conveyed to a development area where a surface of the development roller is closest to the photosensitive roller, flies and adhered to an electrostatic latent image on the photosensitive drum with the electrical force of attraction using a predetermined voltage applied to the development area. Consequently, the latent image is visualized and developed. Next, the reset roller removes the residual toner on the development roller that is left in a no-image area where no latent image is formed. The development process repeats a series of these operations.

However, the conventional noncontact-type development method employing the nonmagnetic and single component developer would disadvantageously deteriorate the image quality depending on development conditions. The present inventors, as a result of their thorough study on what causes such image deterioration, have discovered that the image quality depends on the toner layer formation and toner's electrical properties.

The toner layer would result, if too thin, in the low and uneven image density, while, if too thick, would increase a proportion of oppositely charged or low charged toner, thereby fogging the no-image area. The present inventors have discovered that the toner layer formation physically relies upon four parameters (though the parameters are not limited to these four) including a surface roughness of the development roller, a blade pressure, a toner particle diameter, and a charge amount of toner, and that these parameters should be controlled correlatively to some extent.

The inappropriate surface roughness of the development roller would constitute an obstacle to form a uniform toner layer. The surface roughness serves as a mechanical force for conveying the toner and as a spacer between the development roller and the blade. The surface roughness, if too small, would make a toner layer too thin and lower the image density, while, if too large, would make the toner layer too thick and thereby produce a fog in the no-image area (i.e., undesirably coloring with the toner an area which has no image and is therefore expected to be white clarity). In addition, if the blade pressure is too low, the toner layer thickness locally could not be regulated, and toner would easily escape from the blade. If the blade pressure is too high, toner would be so stressed as to produce a fusion of toner into the blade, and would be likely to deteriorate the toner charging. The toner layer thickness would vary with the toner particle diameter. Furthermore, if the toner charge amount is too large, the reflection force as the toner electric attraction force onto the development roller would increase and the toner layer would become thick. As a result, an increase of the blade pressure would raise a mechanical stress to the toner, and thereby tend to deteriorate the toner. On the contrary, if the toner charge amount is too small, the electric attraction force would be small and the toner layer would become thin. As a result, the blade pressure would need to be kept low, but this would cause the toner escape.

Furthermore, the instant inventors have discovered that the formation of the toner layer mechanically depends also upon (but is not limited to) a blade shape and a toner flow between the reset roller and the development roller. Now consider a conventional development device 1, for example, in which a blade 2 comprises a metal plate 2*a* and a rubber plate 2*b* stuck to the metal plate 2*a,* and comes into contact with a development roller 4 through the rubber plate 2*b* as shown in FIG. 8. Hereupon, FIG. 8 is a partially enlarged sectional view of the development device 1 employing conventional nonmagnetic and single component toner T. The conventional development device 1, as understood from FIG. 8, disadvantageously generates toner agglomeration TB at the top of the blade 2. The toner agglomeration TB occurs when the top of the blade 2 blocks, as shown by an arrow, the flow between the reset roller (not shown) and the development roller 4.

This toner agglomeration TB may locally apply the pressure between the blade 2 and the development roller 4, and would cause the excessive toner T to pass the blade 2 to the development roller 4, or on the contrary, to hinder the proper amount toner T from passing to the blade 2. Consequently, as shown in FIG. 9, the uniform toner layer may be unable to be formed. Hereupon, FIG. 9 is a partial schematic transverse section illustrating a state of the development roller 4 and the toner layer TL formed thereon. Failure to form a uniform toner layer would cause a degradation of image quality such as an uneven density and a white clarity as described above. Although the present inventors have considered processing of the rubber plate 2*b* into such a shape (e.g., as a bevel) that does not prevent the toner from flowing, they have discovered that the rubber plate 2*b* having a complex shape easily bent and altered its shape, increasing the difficulty to form a uniform toner layer TL. In addition, a blade made of an elastic member generally has disadvantages in difficulty in manufacturing, low durability, and high manufacturing cost.

On the other hand, with regard to the toner's electrical properties, the present inventors have paid attention to toner's volume resistivity. The present inventors have experimentally developed a filled-in image (such an image that a whole printable area is solidly filled) by employing commercially available or experimentally prepared toners having various resistance values. The instant inventors has resultantly discovered that, regardless of whether the toner has a uniform layer in thickness, use of some toners having certain resistance values in the noncontact-type development produced a stripe of black, or other colors if printed in multiple colors, in the paper feed direction, thereby deteriorating the image quality. The present inventors have assumed that this was because a high toner resistance value produces excessive charging in toner, which would lead to a dielectric breakdown inside the toner, causing uneven streaks.

BRIEF SUMMARY OF THE INVENTION

Therefore, it is an exemplified general object of the present invention to provide a novel and useful developer, development method, development device and its elements, and image-forming device in which one or some of the above disadvantages are eliminated.

Another exemplified and more specific object of the present invention is to provide developer, development method, development device and its elements, and image-forming device that can stably form a high-quality image by a relatively inexpensive and easy means.

In order to achieve the above objects, a developer layer forming method according to one aspect of the present invention comprises the steps of charging nonmagnetic and single component developer having a volume average particle diameter D ($\mu$m) to an average specific charge q/m ($\mu$C/g), supplying said charged developer to a development roller having ten-point surface roughness Rz ($\mu$m), and forming a layer of a single component developer having a layer thickness dt ($\mu$m) on the development roller by providing a blade in contact with the development roller at a blade line pressure Pb (gf/cm), wherein dt, Pb, q/m and D meets the following relationships: $4 \leqq D \leqq -12$, $5 \leqq q/m \leqq 12$, $1 \leqq Rz \leqq 12$, $20 \leqq Pb \leqq 80$, $dt = 1.8 \times \{q/m \times Rz/(Pb-1)\}^{1/2} \times D \pm 0.25$ D, and $1.5\ D \leqq dt \leqq 3.5$ D. It has been experimentally demonstrated that a developer layer having a uniform thickness can be stably formed according to this developer layer forming method.

A development device of another aspect of the present invention comprises a development roller having a ten-point average surface roughness Rz ($\mu$m), and a blade in contact with the development roller at a blade line pressure Pb (gf/cm), capable of forming a layer of a nonmagnetic and single component developer having a volume average particle diameter D ($\mu$m) and an average specific charge q/m ($\mu$C/g) on the development roller, the layer having a thickness dt ($\mu$m), and dt, Pb, q/m and D meeting the following relationships: $4 \leqq D \leqq 12$, $5 \leqq q/m \leqq 12$, $1 \leqq Rz \leqq 12$, $20 \leqq Pb \leqq 80$, $dt = 1.8 \times \{q/m \times Rz/(Pb-1)\}^{1/2} \times D \pm 0.25$ D, and $1.5\ D \leqq dt \leqq 3.5$ D. It has been experimentally demonstrated that a developer layer having a uniform thickness can be stably formed according to this development device.

A development device of another aspect of the present invention comprises a metal development roller, and a blade contactable with the development roller at a predetermined blade pressure to form a layer of a nonmagnetic and single component developer on the development roller, wherein the blade includes a metal contact portion contactable with the development roller, the contact portion having a shape selected from a group consisting of sectionally acute-angled, curved, and round shapes. According to this development device, the contact portion having the shape in section of an acute angle, a curve, or a round can serve to prevent a toner agglomeration blocking a toner flow from forming and the toner from adhering and destroying.

A development device of still another aspect of the present invention comprises a metal development roller, and a blade contactable with the development roller at a blade pressure of 20 through 80 gf/cm to form a layer of a nonmagnetic and single component developer, wherein the blade includes a metal contact portion having a surface roughness less than a surface roughness of the development roller. According to this development device, a toner fusion to the blade can be avoided by controlling a surface roughness of the development roller and the blade, and the blade pressure.

A developer of one aspect of the present invention is usable for noncontact-type development process, comprises a colored fine particle and a fluidizing agent, and has a volume resistivity of about more than 10 G$\Omega$·cm but about less than 192 G$\Omega$·cm. A container of one aspect of the present invention stores the above nonmagnetic and single component developer. The nonmagnetic and single component developer has a resistance value experimentally evaluated as appropriate.

An image-forming device of one aspect of the present invention comprises a photosensitive drum, a charger which charges the photosensitive drum, an exposure part which exposes the photosensitive drum charged by the charger, and forms an electrostatic latent image, a development device which develops the photosensitive drum exposed, and visualizes the electrostatic latent image as a toner image, and a transfer part which transfers the toner image onto a recorded medium, wherein the development device comprises any of the above-described development devices. This image-forming device has the same effect as the above development devices.

An image-forming device as an exemplified embodiment of the present invention comprises a photosensitive drum, a charger which charges the photosensitive drum, an exposure part which exposes the photosensitive drum charged by the charger, and forms an electrostatic latent image, a development device including a development roller spaced apart from the photosensitive drum exposed, said development roller flying a nonmagnetic and single component developer to the photosensitive drum, developing the photosensitive drum, and visualizing the electrostatic latent image as a toner image, the developer having a volume resistivity of about more than 10 G$\Omega$·cm but less than 192 G$\Omega$·cm, a transfer part which transfers the toner image onto a recorded medium, and a container which stores the nonmagnetic and single component developer. According to this image-forming device, the nonmagnetic and single component developer has a resistance value experimentally evaluated as appropriate.

Other objects and further features of the present invention will become readily apparent from the following description of the embodiments with reference to accompanying drawings.

DETAILED DESCRIPTION OF PREFERRED EMBODIMENTS

Figure 1:
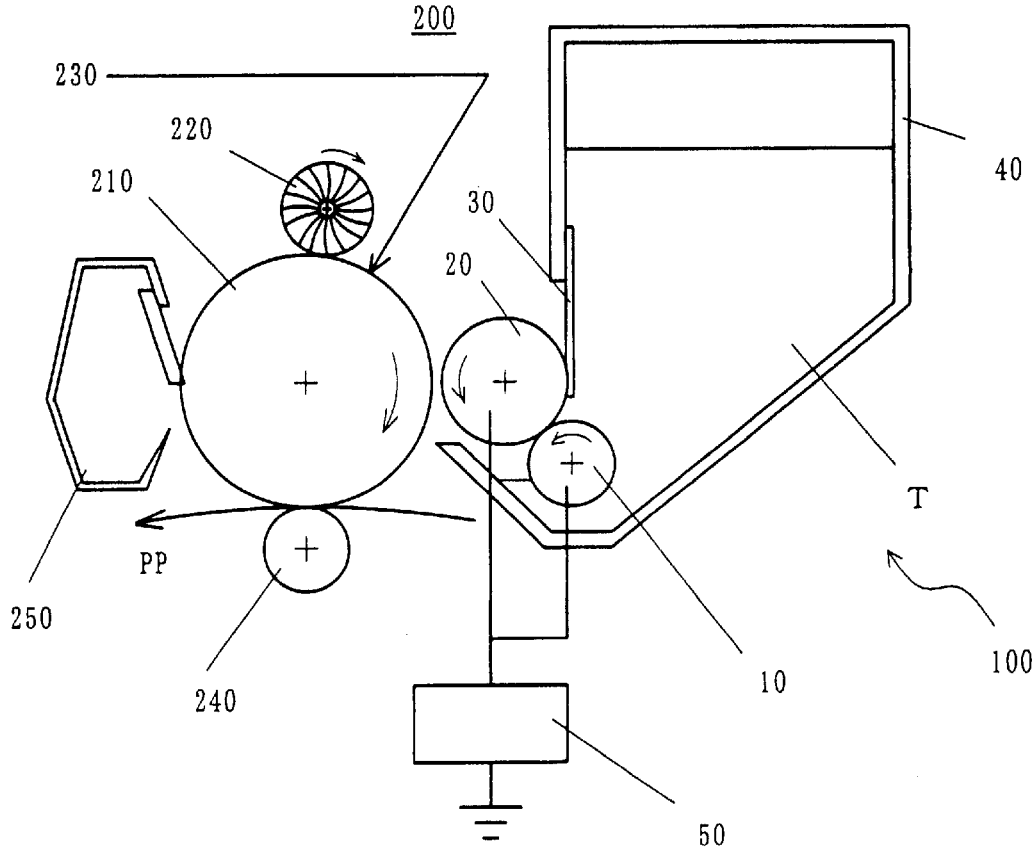
FIG. 1 is a partial principal section of a development device and image-forming device of one aspect of the present invention.

A description will now be given of a development device 100 and an image-forming device 200 including the development device 100 of one aspect of the present invention with reference to FIG. 1. Those elements in each figure designated by the same reference numerals denote the same elements, and a duplicate description thereof will be omitted. Those elements designated by the same reference numeral with capital alphabetical letters attached thereto generally denote variations, and, unless otherwise specified, are generalized by simple reference numeral without alphabets. Hereupon, FIG. 1 is a principal schematic sectional view of the image-forming device 200 having the development device 100. The development device 100 comprises a reset roller 10, a development roller 20, a blade 30, a frame 40, and a development bias power supply 50.

I. Formation of Toner Layer by Controlling Physical Parameters

First of all, the present inventors have considered stably forming a toner layer having a uniform thickness on the development roller 20 to obtain high-quality images. The toner layer, if too thin, would disadvantageously result in a low and uneven image density. The toner layer, if too thick, would increase a proportion of oppositely charged or low charged toner, thereby fogging no-image areas. The present inventors have discovered, as a result of various experiments which will be described later, that a formation of a toner layer having a uniform thickness physically relies on (but is not limited to) four parameters including a surface roughness of the development roller, a blade pressure, a toner particle diameter, and toner's charge amount, and that these parameters should be controlled correlatively to some extent. Next follows a description of the experiments and analyses thereof.

The reset roller 10, which is also called a supply roller or application roller, contacts with the development roller 20 and supplies a toner T from the frame 40 to the development roller 20. The reset roller 10 is made of electroconductive materials such as sponge in order to charge the toner T by friction with the development roller 20. FIG. 1 in the present embodiment illustrates that the reset roller 10 rotates to the left (counterclockwise), and contacts with the development roller 20. This contact and rotation charges the toner T and supplies it to the development roller 20. Moreover, the reset roller 10 may also serve to collect the residual toner T unused for the development and left on the development roller 20. The toner T on the development roller 20, when attempted to be collected, is scraped off by utilizing the contact between the rollers 10 and 20, and returned to the inside of the frame 40.

The development roller 20 adsorbs the toner T on its surface, and, as rotating, conveys the toner T to the development area. The development area is an area where the photosensitive roller 210 and the development roller 20, which will be explained later, are set closest together. The development roller 20, for example, rotates at the same speed and in the same direction as the photosensitive drum 210. A usable material for the development roller 20 may include a metal such as aluminum and stainless steel. An application of voltage to these electroconductive materials allows to adsorb the toner T by utilizing electrostatic adsorption. In the present embodiment, an experiment was carried out with an aluminum development roller 20 of 20 mm in outer diameter and a stainless steel blade 30. The experimental conditions were as follows: a surface roughness of the aluminum development roller was sandblasted with irregularly or regularly (spherically) shaped glass beads as grinding grains and adjusted to a predetermined ten-point average roughness Rz. The development roller 20 that used those having Rz values experimentally varied between 1 $\mu$m and 12 $\mu$m was prepared and an optimum surface roughness was explored.

The blade 30 is a member serving to restrict to a predetermined thickness the toner T supplied by the reset roller 10, and is made of an elastic body typified by urethane, etc., a metal having leaf spring properties such as stainless steel and bronze. A method of regulating the toner layer TL varies with these materials and includes scraping and pressing. The present embodiment prepares as the blade 30 three kinds of stainless steel plate members having different thickness respectively of 0.10 mm, 0.12 mm, and 1.50 mm, and brings it into contact with the development roller 20 at a predetermined pressure. The blade pressure may be adjusted by varying three factors of a blade plate pressure, a free length corresponding to a distance from a blade support part to a roller contact portion, and a deflection amount, using the following equation 1. The present embodiment varied the blade pressure worked out with the equation 1 in a range from 10 to 100 g/cm, and determined the optimum value.

$$W = \frac{3\delta \cdot E \cdot b \cdot h^3}{12L^3} = \frac{\delta \cdot E \cdot b \cdot h^3}{4L^3} \quad (1)$$

W is a total load of the blade pressure, δ a deflection amount, E elasticity modulus, b a blade width, h a plate thickness, and L a free length.

The frame 40 stores the toner T, supplies it to the reset roller 10, and accepts toner collected by the reset roller 10.

The frame 40 includes a puddle, an agitator, and other components (not shown), and is connectable to an external toner storage container such as a toner cartridge. The bias power supply 50 includes superposed AC/DC power supplies.

The toner T was selected from nonmagnetic and single component developers that are in common use, and prepared, for example, by kneading fine carbon particles as a colorant and a charge control agent with a polyester resin, and pulverized into a predetermined volume average particle diameter. Optionally, an offset inhibitor made of low-molecular material such as wax, polyethylene, and polypropylene may be used for (included in) the toner T if necessary. Thereafter, a powder smaller than 3 μm and coarse particles equal to or larger than 20 μm were removed, and the remaining particles were externally added and coated at its surface with fine particles of silicon oxide and titanium oxide to provide fluidity and charge. This toner T has such thermal characteristics that its glass transition temperature ranges between 55 and 67° C., and its melting point ranges between 120 and 150° C. A large gap between the glass transition temperature and the melting point is due to its broad range of a coating ratio of external additives, a molecular distribution and cross-linking degree of styrene resin. The experiment used the toner T having its volume average particle diameter of 7.5 μm. The toner T is obtainable by not using the above-described pulverizing method, but using any preferred method such as a polymerization process, a spray-drying process and other powder-making processes.

The charge amount of toner T was determined by measuring a state of the toner layer TL on the development roller 20 using the E-spart analyzer (manufactured by Hosokawa Micron Corporation). The most desirable specific toner charge q/m in light of the toner layer formation and image quality is −5 μC/g through −30 μC/g. The specific toner charge less than −5 μC/g would make the toner layer thin because of its low reflection force as an attraction force to the development roller 20, and would prevent the toner, in development, from flying steadily across the gap between the development roller 20 and the photosensitive drum 210 under the development bias voltage, thereby lowering the image density. On the contrary, the specific toner charge q/m more than −30 μC/g would raise its reflection force, and lowers the development efficiency. Moreover, since the higher specific charge would make it difficult to regulate the toner, the surface roughness of the development roller 20 needs be small while the blade pressure needs be high.

The experiment brought the reset roller 10 into contact with the development roller 20 at the contact depth of 1 mm, and rotated the both rollers to the left. Accordingly, the reset roller 10 and the development roller 20 were rotated opposite in direction to each other at their contact point. The reset roller 10 having such a structure as a metal shaft coated with a urethane foam exhibiting conductivity was adjusted to 20 mm in outer diameter and $10^7$ Ω in resistance between the shaft and foam. The rotation speed of both the reset roller 10 and the development roller 20 were adjusted to 90 mm/s.

The present embodiment used a metal roller for the development roller 20, and avoided its contact with the photosensitive drum 210 that is rigid, in accordance with the noncontact-type development method, setting the gap to be 350 μm at their closest point between the photosensitive drum 210 and the development roller 20. The present invention however is not intended to preclude the contact-type development method in which the development roller 20 touches the photosensitive drum 210.

The development voltage bias, adding the DC voltage as an offset to the AC voltage, more specifically, had a frequency of 1.0 kHz through 2.5 kHz, a peak-to-peak voltage Vpp of 1.8 kHz through 2.5 kHz, an offset voltage of −400 V through −550 V, and a duty ratio of 30% through 50%. The AC waveform has as a rectangular shape. The electrical potential at the surface of the photosensitive drum 210 was −600 V, and the electrical potential of the exposed latent image area was approximately −50 V.

The experimentation negatively charged the toner T by the friction with a contact nip of the reset roller 10 and the development roller 20, and supplied it using the reflection force as an electrostatic force and the mechanical force, thereby absorbing it onto the development roller 20. The toner T on the development roller 20 as adsorbed in excess may be regulated with the blade 30. Then, as described above, the thickness of the toner layer TL is controlled by the factors including the surface roughness Rz of the development roller 20, the blade (line) pressure Pb, the volume average particle diameter D of the toner T, and the charge amount q/m, and variable on the order of some μm to 100 μm.

The toner layer TL regulated at a predetermined thickness is fed to the development area where the development roller 20 and the photosensitive drum 210 are closest to each other. Subsequently, the toner T flies towards an electrostatic latent image formed on the surface of the photosensitive drum 210 under the development bias voltage, and the latent image is visualized as a toner image.

The toner layer TL was formed based on the aforementioned experimental condition, and the effects each condition exerts on a state of the toner layer formation and an image quality are presented in Tables 2 through 7.

Table 2 shows the experimental results when the surface roughness of the development roller 20 is provided with a constant value of 1 μm.

TABLE 2

| Surface Roughness Rz (μm) | Blade Line Pressure Pb (gf/cm) | Specific Charge q/m (μC/g) | Toner Layer Thickness dt (μm) | Image Quality |
|---|---|---|---|---|
| 1 | 11.0 | 17.5 | 22.5 | some fogs, and escape from blade occurred |
| 1 | 22.7 | 17.4 | 14.8 | slightly low image density |
| 1 | 32.4 | 18.3 | 10.0 | low image density |
| 1 | 48.1 | 19.8 | 11.3 | low image density |
| 1 | 63.2 | 21.9 | 4.3 | low image density, and uneven toner layer |
| 1 | 76.6 | 21.6 | 3.5 | low image density, and uneven toner layer |
| 1 | 93.9 | 23.2 | 3.2 | low image density, and uneven toner layer |

For the relatively small surface roughness, even if the blade (line) pressure Pb is made lower, the toner layer thickness dt becomes thin and therefore the image density becomes low. Under such condition that the blade line pressure Pb was the lowest (i.e., 11.0 gf/cm), the toner T escaped from the blade 30. Accordingly, the blade line pressure Pb is required to be at least a load higher than 11.0 gf/cm.

The toner layer thickness dt smaller than 10 μm would possibly cause the unstable formation of the toner layer TL, thereby making the image density low and uneven. In order to achieve a high-quality printing, it is preferable to set the toner layer thickness dt to be 1.5 times larger than the toner volume average particle diameter D.

Table 3 shows the experimental result where the surface roughness (ten-point average roughness) Rz of the development roller 20 was constantly kept 5 μm. It has turned out that a range of the blade pressure Pb required to form a good toner layer TL can extend relatively wide under this condition.

TABLE 3

| Surface Roughness Rz (μm) | Blade Line Pressure Pb (gf/cm) | Specific Charge q/m (μC/g) | Toner Layer Thickness dt (μm) | Image Quality |
|---|---|---|---|---|
| 5 | 11.0 | 16.9 | 39.7 | thick toner layer, many fogs, and escape from blade occurred |
| 5 | 22.7 | 17.3 | 28.4 | thick toner layer, many fogs |
| 5 | 32.4 | 18.6 | 21.9 | some fogs |
| 5 | 48.1 | 19.5 | 14.7 | good |
| 5 | 63.2 | 20.4 | 15.0 | good |
| 5 | 76.6 | 20.7 | 12.8 | slightly low image density |
| 5 | 93.9 | 21.8 | 10.7 | low image density |

Table 4 shows the experimental result where the surface roughness Rz of the development roller 20 was constantly kept 8 μm. This condition formed, similar to the above surface roughness Rz kept 5 μm, a good toner layer TL in a relatively wide range, but caused fogs more widely than that where Rz was 5 μm. Since the image quality was good when the blade pressure was 93.9 gf/cm, a successive print test was performed. Consequently, a blade fusion occurred after eight hours. The blade fusion means that a blade and a toner generate the heat, and the toner is melted by the heat and adhered to the blade. This is because the too high blade pressure Pb increased a stress to the toner T.

TABLE 4

| Surface Roughness Rz (μm) | Blade Line Pressure Pb (gf/cm) | Specific Charge q/m (μC/g) | Toner Layer Thickness dt (μm) | Image Quality |
|---|---|---|---|---|
| 8 | 11.0 | 16.0 | 41.4 | thick toner layer, many fogs, escape from blade occurred |
| 8 | 22.7 | 16.8 | 35.7 | thick toner layer and many fogs |
| 8 | 32.4 | 17.5 | 31.2 | thick toner layer many fogs |
| 8 | 48.1 | 18.6 | 23.6 | some fogs |
| 8 | 63.2 | 19.4 | 22.9 | good |
| 8 | 76.6 | 20.9 | 18.3 | good |
| 8 | 93.9 | 21.0 | 15.6 | good, blade fusion and low density after 8-hr print on end |

Table 5 shows the experimental result where the surface roughness Rz of the development roller 20 was constantly kept 12 μm. Where the surface roughness Rz was the highest, the result shows that the toner layer thickness dt tends to be thick, and the fogs easily occur. The blade pressure Pb should be increased to restrain fogs, but the increased blade pressure Pb would disadvantageously cause the above fusion easily.

TABLE 5

| Surface Roughness Rz (μm) | Blade Line Pressure Pb (gf/cm) | Specific Charge q/m (μC/g) | Toner Layer Thickness dt (μm) | Image Quality |
|---|---|---|---|---|
| 12 | 11.0 | 16.2 | 51.8 | thick toner layer, many fogs, escape from blade occurred |
| 12 | 22.7 | 16.5 | 45.2 | thick toner layer, many fogs |
| 12 | 32.4 | 18.3 | 33.0 | thick toner layer, many fogs |
| 12 | 48.1 | 19.1 | 31.7 | thick toner layer, many fogs |
| 12 | 63.2 | 18.8 | 26.2 | some fogs |
| 12 | 76.6 | 20.1 | 21.2 | good, continuous 10-hr print caused blade fusion |
| 12 | 93.9 | 21.0 | 19.5 | good, continuous 8-hr print caused blade fusion |

Table 6 shows the experimental result where the development roller 20 could stably form a toner layer of a uniform thickness and had the surface roughness Rz of 5 μm, with the relatively low charged toner T. For the low charged toner T, the toner layer thickness dt became thin and the image quality became low. When the blade pressure Pb was low at 11.0 gf/cm, a lot of toner escaped from the blade, similar to Table 3.

TABLE 6

| Surface Roughness Rz (μm) | Blade Line Pressure Pb (gf/cm) | Specific Charge q/m (μC/g) | Toner Layer Thickness dt (μm) | Image Quality |
|---|---|---|---|---|
| 5 | 11.0 | 4.9 | 18.1 | slightly low image density, escape from blade occurred |
| 5 | 22.7 | 6.8 | 15.3 | good |
| 5 | 32.4 | 7.8 | 12.3 | low image density |
| 5 | 48.1 | 8.2 | 11.2 | low image density |
| 5 | 63.2 | 9.9 | 11.9 | low image density |
| 5 | 76.6 | 12.1 | 8.1 | low image density, unstable toner layer formation |
| 5 | 93.9 | 11.9 | 6.2 | low image density, unstable toner layer formation |

Table 7 shows the experimental result where the development roller 20 could stably form a toner layer of a uniform thickness and had the surface roughness Rz of 5 μm, with the relatively highly charged toner T. For the highly charged toner T, the toner layer thickness dt became thick, and fogs tended to occur. A lot of toner also escaped from the blade 30, because the toner bore so high electric charge as to adhere strongly to the development roller 20. In other words, the toner T had a high reflection force.

TABLE 7

| Surface Roughness Rz (μm) | Blade Line Pressure Pb (gf/cm) | Specific Charge q/m (μC/g) | Toner Layer Thickness dt (μm) | Image Quality |
|---|---|---|---|---|
| 5 | 11.0 | 26.2 | 53.2 | thick toner layer, many fogs, escape from blade occurred |
| 5 | 22.7 | 28.3 | 42.2 | thick toner layer, many fogs escape from blade occurred |
| 5 | 32.4 | 30.4 | 30.8 | thick toner layer, many fogs |
| 5 | 48.1 | 35.2 | 26.2 | fogs |
| 5 | 63.2 | 33.9 | 22.9 | some fogs |
| 5 | 76.6 | 32.5 | 20.2 | good slightly low image density, |
| 5 | 93.9 | 35.3 | 16.3 | continuous 8-hr print caused blade fusion |

Figure 2:
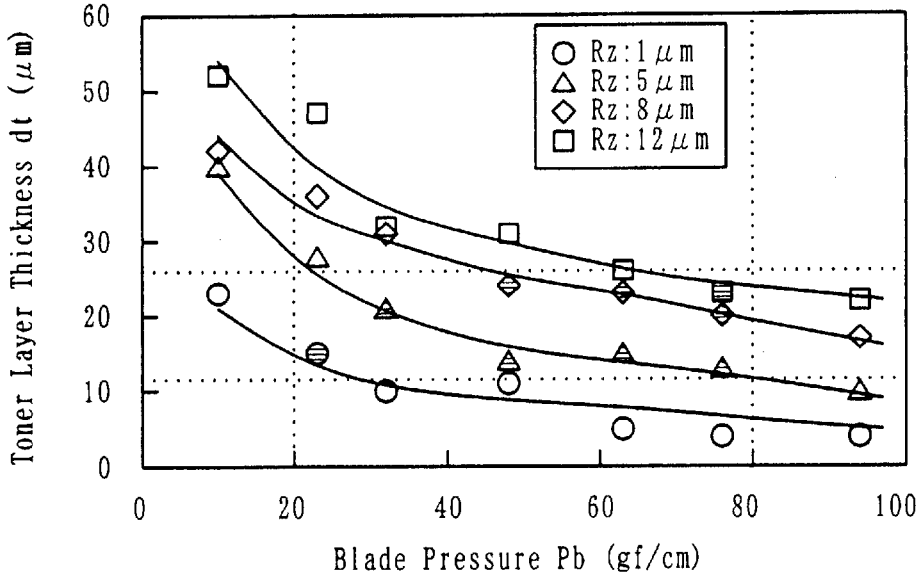
FIG. 2 is a graph representing data of Tables 2 through 5.
Figure 3:
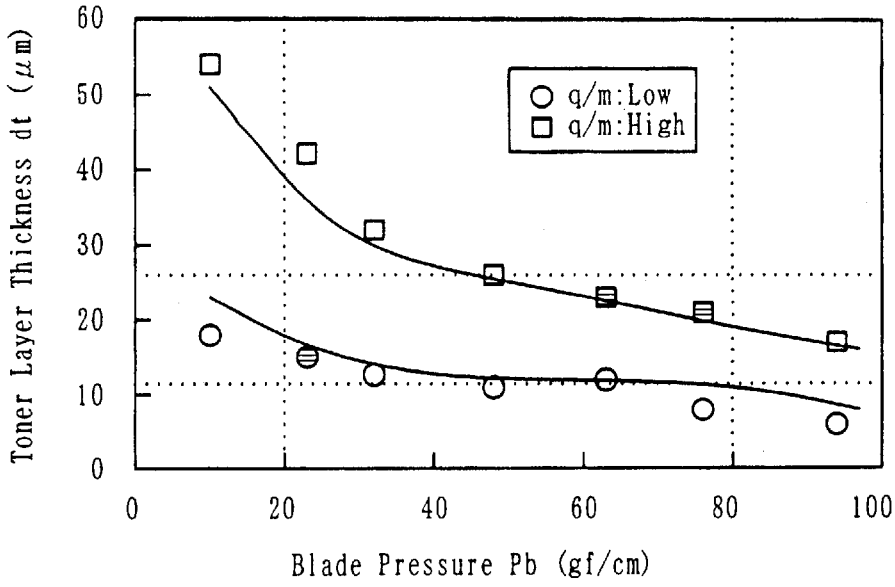
FIG. 3 is a graph representing data of Tables 6 and 7.

The foregoing experimental results are arranged in FIG. 2 for Tables 2–5 and FIG. 3 for Tables 6 and 7. In view of these relationships the following equation 2 could be induced with respect to the thickness dt of the toner layer TL on the development roller 20, the volume average particle diameter D of the toner T, the toner specific charge amount q/m on the development roller 20, the ten-point average surface roughness Rz of the development roller 20, and the blade line pressure Pb.

$$dt=1.8\times\{q/m\times Rz/(Pb-1)\}^{1/2}\times D\pm 0.25\ D,\ 1.5\ D\leqq dt\leqq 3.5\ D \qquad (2)$$

Hereupon, each dot denotes an experimental value in FIGS. 2 and 3, and a solid line is derived from the equation 1. This equation is satisfied under the conditions shown in Table 8.

TABLE 8

| | | |
|---|---|---|
| Vol. Average Particle Diameter D | 4–12 μm | Toner smaller than 4 μm does not exist at present (though it would meet the equation, no sample is available). Toner larger than 12 μm would cause a deteriorated resolution in image quality. |
| Toner Specific Charge Amount q/m | 5–30 μC/g | Less than 5 μC/g, toner layer would easily become thin, and lower development efficiency. Exceeding 30 μC/g, toner could not be properly regulated and thereby escaped from the blade. |
| Sur. Rough. Rz of Devel. Roller | 1–12 μm | Smaller than 1 μm, toner layer would easily become thin. Exceeding 10 μm, toner layer would be thick and cause fogs. |
| Blade Line Pressure Pb | 20–80 g/cm | If less than 20 g/cm, toner would easily escape. If more than 80 g/cm, blade fusion would easily occur. |

Although the present embodiment makes the development roller 20 of aluminum and the blade 30 of stainless steel, both members may be selected from any electrically conductive rigid members. This is to prevent the blade 30 from electrically floating. Thus, alternatively, the blade 30 may be connected with another bias power supply, or only a surface of a nonconductive blade is processed to be conductive. The similar effect would be available even though it is not made of metal but its surface is coated with a conductive resin on its surface. However, the blade 30 is preferably made, for example, of a leaf spring member and contacts the development roller 20 (not at the end portion but) at the midsection so as to avoid damaging the development roller 20.

According to the toner layer forming method and device of one aspect of the present invention, it is possible to stably form a toner layer having a uniform thickness on the development roller 20 under the conditions of the equation 2 employing the metal development roller 20 and blade 30, each of which may be manufactured with high processing accuracy and at a relatively low cost, and equipped with characteristically reliable stabilities. This resultantly can avoid a reduced image density, increased fogs in the non-image area, toner escapes from the blade, and toner fusion to the blade and deteriorated toner charge due to the high stress, thereby obtaining high-quality images.

II. Formation of Toner Layer by Controlling Mechanical Parameters

The present inventors have then discovered that a formation of a toner layer having a uniform thickness mechanically depends upon (but is not limited to) a blade shape and a toner flow between the reset roller and the development roller, and have considered improving them. The conventional structure that uses the metal development roller 20 and metal blade 30 to form a toner layer includes, as described above with reference to FIGS. 8 and 9, the rubber plate 2*b* at a front top of the blade 2 under the apprehension that the contact between the metal members might hurt each other and alter their properties such as the surface roughness. However, this would produce the toner agglomeration TB entailing a variety of disadvantage as described above.

Figure 4:
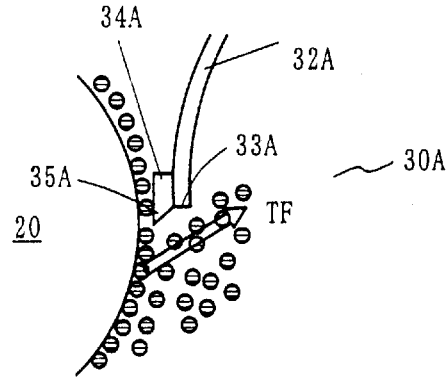
FIG. 4 is a partially enlarged sectional view of another embodiment relating to a toner layer-forming method by the development device.
Figure 5:
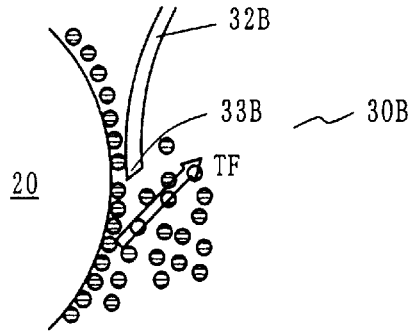
FIG. 5 is a partially enlarged sectional view of another embodiment relating to the toner layer-forming method by the development device.
Figure 6:
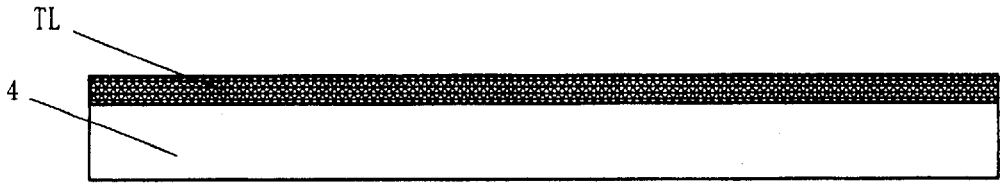
FIG. 6 is a partially schematic transverse section illustrating a state of a toner layer formed on a development roller using the development device shown in FIGS. 4 and 5.

The present embodiment proposes that the blade 30 be replaced with a blade 30A shown in FIG. 4 or a blade 30B shown in FIG. 5. Referring now to FIGS. 4 to 6 inclusive, a description will be given of the blades 30A and 30B. Hereupon, FIG. 4 is a partially enlarged sectional view of the blade 30A and the development roller 20 according to the present embodiment. FIG. 5 is a partially enlarged sectional view of the blade 30B and the development roller 20 according to the present embodiment. FIG. 6 is a partial schematic transverse section illustrating a state of a toner layer formed on the development roller 20 using the blade 30A shown in FIG. 4 and the blade 30B shown in FIG. 5.

Although the development roller 20 shown in FIGS. 4 and 5 are both made of aluminum, the present invention does not intend to preclude one or both of the development rollers 20 shown in FIGS. 4 and 5 from being made of resin, etc.

Figure 8:
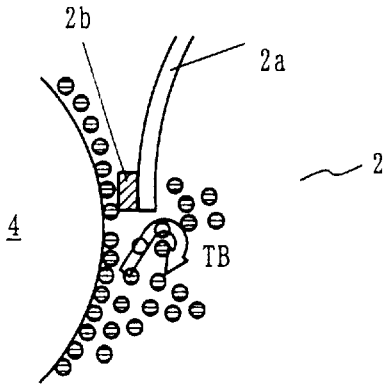
FIG. 8 is a partially enlarged section of a conventional development device employing a conventional toner-layer forming method.
Figure 9:
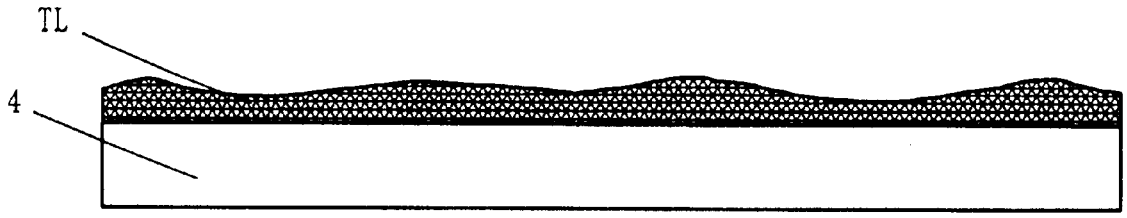
FIG. 9 is a partially schematic transverse section illustrating a state of a toner layer formed on the development roller by using the development device shown in FIG. 8.

The blade 30A shown in FIG. 4 comprises a rubber base 32A as a pressurizing portion applying the predetermined blade pressure to the development roller 20 and making uniform the thickness of the toner layer TL and a metal plate 34A as a contact portion with the development roller 20. The plate 34A is made, for example, of stainless steel, includes the end portion 35A having a sectional shape of an acute angle, a curve, or a round at its edge, so that a toner flow TF (shown with an arrow) between the reset roller 10 (both not shown) and development roller 20 may not be blocked. As a result, the blade 30A can prevent the toner agglomeration TB and the cohesion of the toner T at its edge portion 33A as shown in FIG. 8.

The plate 34A, as made of metal, is superior to the rubber plate 2*b* in manufacturability, durability, strength, and manufacturing costs. For example, it is difficult and costly to manufacture a relatively small rubber plate 2*b* like a plate 34*b* in shape. Furthermore, the rubber plate 2*b* shaped sectionally acute-angled and round would bend and deform in the arrowed toner flow direction TF, consequently creating a new toner agglomeration, and/or preventing the desired blade pressure from being applied to the development roller 20.

Optionally, the end portion 33A of the base 32A may also be shaped sectionally acute-angled, curved or round (i.e., round-edge) in accordance with the plate 34A like the end portion 33B that will be described below. Preferably, the plate 34A may adopt such a center contact in which it contacts the development roller 20 not at the edge but at the midsection of the end portion 33B. This may prevent the blade 30A from damaging the development roller 20.

Similarly, the blade 30B shown in FIG. 5 is made as one member of a metal base 32B. The base 32B includes the end portion 33B having a sectional shape of an acute angle, a curve, or a round (i.e., round edge) at its edge like the end portion 35A. Since the base 32B is so manufactured that a toner flow TF (shown by an arrow) between the reset roller 10 (not shown) and the development roller 20 may not be blocked, the blade 30B can prevent the toner agglomeration TB and cohesion of the toner T at the end portion 33B as shown in FIG. 8. The base 32B, as made of metal, is superior to the rubber plate 2*b* in manufacturability, durability, strength, and manufacturing costs. Preferably, the base 33A may adopt the center contact in which it contacts the development roller 20 not at the edge but main portion of the end portion 33B, thereby preventing the blade 30B from damaging the development roller 20.

Both of the blade 30A and blade 30B used in the instant embodiment may provide, as shown in FIG. 6, the uniform thickness dt of the toner layer on the development roller 20. Laser Scan Micrometer manufactured by Keyence Corporation may be used to measure the uniformity, for example. When the blade 30A was used the toner layer thickness dt was 18±4 μm, whereas when the blade 30B was used the toner layer thickness dt was 18±2 μm. The volume average particle diameter of the toner is approximately 8 μm, while the toner layer thickness may preferably be 12 through 28 μm, more preferably 16 through 20 μm; therefore it is to be understood that a good thickness of the toner layer may be formed, no matter which blade is used, 30A or 30B of the instant embodiment.

A dispersion of the toner layer thickness conventionally ranges ±5–10 μm, whereas the present embodiment represents the dispersion ranging ±2–3 μm. Where the surface roughness Rz of the development roller 20 is 5 μm, if that of the blade 30 is set smaller than 1 μm, a fine toner production by pulverizing toner may be prevented, and a fusion of the toner T onto the blade 30 may also be prevented. Consequently, the surface roughness of the blade 30 is preferably set smaller than that of the development roller 20. More preferably, the surface roughness of the blade 30 may be 1 μm or smaller, and that of the development roller 20 may be 1 μm or larger.

In the fusion, the development roller 20 rotated at idle for 5 hours without fusion was evaluated good. When the blade 30 having a surface roughness of 5 μm or larger was used, a fusion occurred after 2 to 3 hours. The pressure to the toner layer TL at this time was 30 fg/cm. Even if the blade 30 having a surface roughness of 1 μm or smaller was used, the pressure in excess of 80 gf/cm resulted in the fusion within 5 hours. The blade pressure may range from 20 through 80 gf/cm, preferably from 30 through 60 gf/cm.

According to the development device including the blade 30A or 30B and the development roller 20 of the present embodiment, sectionally acute-angled, curved or round end portion, may keep the toner flow, avoid forming the toner agglomeration, and stably form a toner layer having a uniform thickness on the development roller 20. In addition, the development device may prevent the toner fusion to the blade by controlling the surface roughness of the development roller 20 and the blade 30, and the blade pressure.

III. Formation of Toner Layer by Controlling Electrical Properties of Nonmagnetic and Single Component Developer The noncontact-type development method employing the nonmagnetic and single component developer of the present embodiment pays attention to toner's volume resistivity. The instant inventors have experimentally developed a filled-in image (such an image that a whole print area is solidly filled) employing commercially available or experimentally prepared toner of varying resistance values regardless of whether the toner has a uniform layer in thickness, and has resultantly discovered that the use of the toner having a certain resistance value in the noncontact-type development produces streaks of black, or other colors if printed in multiple colors, in paper feed direction PP, thereby debasing its image quality. The present inventors have assumed that this was because toner's high resistance value produces excessive charging in the toner, and then caused an insulation breakdown, thereby causing uneven printing like streaks.

The development conditions in this embodiment were as follows: The development device 100 as shown in FIG. 1 was used, the reset roller 10 was made of urethane, the development roller 20 was made of aluminum, the blade 30 was made of stainless steel, and the photosensitive drum 210 was made of an OPC. The distance between the development roller 20 and the photosensitive drum 210 is set 350 μm. To the reset roller 10, the development roller 20 and the blade 30, a rectangular voltage was applied which has a DC voltage of −550 V, a peak-to-peak voltage Vpp of 2.6 kV at a frequency of 2 kHz, and a duty ratio of 35%. The surface of the photosensitive drum 210 was uniformly charged at −600 V, and the electrical potential in the latent image area became −50 V by exposure.

In the method of preparing the nonmagnetic and single component toner used for the present embodiment, 3.0 wt % through 6.0 wt % of a pigment such as carbon black, 0.5 wt % through 4.0 wt % of an antistat including a salycilic metal complex, etc., 1.0 wt % through 3.0 wt % of a wax including a polyethylene system as a main ingredient was added to the polyester binder resin, and then mixed, melted, kneaded, and then pulverized and classified. The toner was prepared by coating toner matrices having a diameter of 6 through 10 μm extracted from the prepared powder, with 0.5 w t % through 3.0 wt % of silica and titanium oxide, etc. that has been made hydrophobic as an external additive. A relationship between streaks and those thus-prepared toners having a variety of resistance value was experimentally elucidated.

The measurement of toner's resistance value and the calculation of a measurement error will now be discussed below. Used devices were TRS-10T Dielectric Loss Measuring Equipment (AS-31356: Ando Electric Co., Ltd.) and SE43 Granular Electrode (AS-20646: Ando Electric Co., Ltd.). The toner measuring procedure follows the steps of first shaping toner in a pellet form, which is easy to measure, and then measuring a resistance value of the pellet. For forming the shape of a pellet, a load of 600 kgf was imposed to toner having a mass of 0.05±0.002 g for one minute in a compressor shaping device having an internal diameter of 13 mm. The pellet thus formed was been measured using the above two devices. The resistance values measured by the above two devices were a capacitance Cx and a conductance Gx. The resistance value R (GΩ·cm) is reckoned by the following equation 3. The measurement environment at the time of experiment was that the temperature was 24° C. and the humidity was 28%.

$$R=A/(Gx\cdot t) \quad (3)$$

where A was a surface area of the pellet (1.33 $cm^2$) and t was a thickness of the pellet.

Since the measurement error of the conductance Gx is represented by (±5% of actually measured Gx)+(measured frequency)×3×$10^{-12}$, the maximum resistance value $R_{max}$, if the measurement error is taken into consideration, may be expressed by the equation 4.

$$R_{max}=A/(0.95Gx-(\text{measured frequency})\times 3\times 10^{-12}) \quad (4)$$

Figure 7:
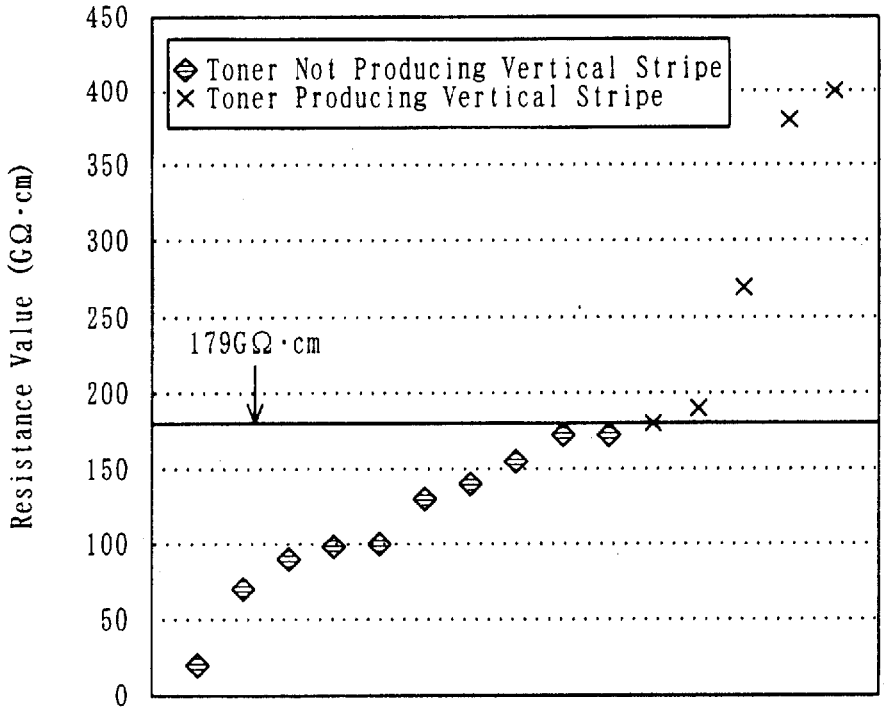
FIG. 7 is a graph showing a relationship between toner resistance values R and vertical streaks.

FIG. 7 shows the experimental result using the above devices under the above conditions. FIG. 7 shows a relationship between toner resistance values R and vertical streaks. It has turned out that the toner having a resistance value R of 179 GΩ·cm or higher as shown in FIG. 7 would produce vertical streaks in developing a filled-in image. Since at least the toner lower than 192 GΩ·cm did not produce a vertical stripe if the above error is taken into consideration, it is preferable to use those toners having a resistance value R less than 192 GΩ·cm to improve the image quality.

It is not true that a low resistance value always improves the image quality, because a use of toner having a lower resistance value (several GΩ·cm) than the toner 1 having the minimum resistance value in the present embodiment might cause a bad transfer, whereby a high-quality image could not be obtained. Accordingly, toner's desirable resistance value R without causing vertical streaks or a bad transfer ranges at least 10 GΩ·cm through 192 GΩ·cm if the measurement error is taken into consideration.

According to the developer of the present embodiment, the control over the resistance value of the developer may prevent an excessive charging in the developer and accompanying isolative breakdown.

IV. Image-Forming Device 200

The image-forming device 200 of one exemplified embodiment of the present invention includes, as shown in FIG. 1, a development device 100, a photosensitive drum 210, a pre-charger 220, an exposure part 230, and a transfer roller 250. The photosensitive drum 210 structurally has a photosensitive dielectric layer on a rotatable drum-shaped conductive support, and may be uniformly charged by the pre-charger 220. For example, the photosensitive drum 210 is an OPC or an aluminum drum to which a separated function organic photosensitive body is applied at a thickness of approximately 20 μm, and the external diameter is, for instance, 20 mm, and rotates at a rotary speed of 90 mm/s in the arrow direction.

The pre-charger 220 is a brush roller charger, and uniformly charges the surface of the photosensitive drum 210 at approximately 600 V. Next, the exposure part 230 uses a laser beam to form an image corresponding to a print source on the photosensitive drum 210. Then, a charging state in an area where an image is formed by the beam on the uniformly charged photosensitive drum 210 is neutralized and canceled (e.g., at −50 V) by the effect of the above conductive support, and a latent image as a reverse charged pattern to the light and shade of the document is formed. The latent image is visualized as a toner image by the development device 100.

In the development device 100, the development roller 20 in contact with the photosensitive drum 210 rotates at the same rotary speed and in the same direction as the photosensitive drum 210. The blade 30 regulates the toner T supplied from the reset roller 10, and forms a toner layer on the development roller 20. As described in some embodiments above, the development device 100 of one exemplified aspect of the present embodiment can stably form a toner layer having a uniform thickness on the development roller 20. The toner is negatively charged by the sliding friction among the reset roller 10, the development roller 20 and the blade 30.

Thereafter, the toner layered on the development roller 20 flies towards and adsorbs to the surface of the photosensitive drum 210 by the development bias voltage applied to the development roller 20 by the bias power supply 50. Toner that has not contributed to the development is scraped off by the backward rotating reset roller 10 below the development roller 20, and returned through the bottom part of the reset roller 30 to the frame 40. The toner image on the photosensitive drum 30 thus obtained is transferred at the transfer roller 240 onto a printing paper, which is timely fed along the feed path PP by feed rollers (not shown). The cleaner 250 collects the remaining toner on the photosensitive drum 210. A transferred printing paper is then fed to a fixing part (not shown), fixed, and finally ejected.

As discussed above, the present invention discovers preferable toner layer forming conditions for the high-quality image formation by measuring image-quality effects for various development conditions of the development roller and blade.

According to the toner layer-forming method of the present invention, a change of a shape and material of the blade edge makes it possible to form a uniform toner layer, thereby achieving the improved image quality.

Further, it is possible to form high-quality images without vertical streaks by measuring and specifying desirable toner resistance values.

What is claimed is:

1. A developer layer forming method comprising the steps of:

charging nonmagnetic and single component developer having a volume average particle diameter D (μm) to an average specific charge q/m (μC/g);

supplying said charged developer to a development roller having ten-point surface roughness Rz (μm); and forming a layer of a single component developer having a layer thickness dt (μm) on said development roller by providing a blade in contact with said development roller at a blade line pressure Pb (gf/cm), wherein dt, Pb, q/m and D meets the following relationships:

$$4 \leqq D \leqq 12;$$

$$5 \leqq q/m \leqq 12;$$

$$1 \leqq Rz \leqq 12;$$

$$20 \leqq Pb \leqq 80;$$

$$dt=1.8\times\{q/m\times Rz/(Pb-1)\}^{1/2}\times D\pm 0.25\ D;$$

and $$1.5\ D \leqq dt \leqq 3.5\ D.$$

2. A development device comprising:

a development roller having a ten-point average surface roughness Rz (μm); and a blade in contact with said development roller at a blade line pressure Pb (gf/cm), capable of forming a layer of a nonmagnetic and single component developer having a volume average particle diameter D (μm) and an average specific charge q/m (μC/g) on said development roller, said layer having a layer thickness dt (μm), and dt, Pb, q/m and D meeting the following relationships:

$$4 \leqq D \leqq 12;$$

$$5 \leqq q/m \leqq 12;$$

$$1 \leqq Rz \leqq 12;$$

$$20 \leqq Pb \leqq 80;$$

$$dt = 1.8 \times \{q/m \times Rz/(Pb-1)\}^{1/2} \times D \pm 0.25\ D;$$

and $$1.5\ D \leqq dt \leqq 3.5\ D.$$

3. A development device according to claim 2, wherein said development roller and said blade each have an electroconductive surface.

4. A development device according to claim 2, further comprising a bias power supply connected with said blade.

5. A development device according to claim 2, wherein said blade is made of a leaf spring in contact with said development roller via a midsection of said blade.

6. A development device according to claim 2, wherein said development roller is made of metal, and said blade is also made of metal.

7. An image-forming device comprising:

a photosensitive body;

a charger which charges said photosensitive body;

an exposure part which exposes said photosensitive body charged by said charger, and forms an electrostatic latent image;

a development device which develops said photosensitive body exposed, and visualizes the electrostatic latent image as a toner image; and a transfer part which transfers said toner image onto a recorded medium, wherein said development device comprises:

a development roller having a ten-point average surface roughness Rz (μm); and a blade in contact with said development roller at a blade line pressure Pb (gf/cm), capable of forming a layer of a nonmagnetic and single component developer having a volume average particle diameter D (μm) and an average specific charge q/m (μC/g) on said development roller, said layer having a layer thickness dt (μm), and dt, Pb, q/m and D meeting the following relationships:

$$4 \leqq D \leqq 12;$$

$$5 \leqq q/m \leqq 12;$$

$$1 \leqq Rz \leqq 12;$$

$$20 \leqq Pb \leqq 80;$$

$$dt = 1.8 \times \{q/m \times Rz/(Pb-1)\}^{1/2} \times D \pm 0.25\ D;$$

and $$1.5\ D \leqq dt \leqq 3.5\ D.$$

* * * * *